US005841336A

United States Patent [19]

Rapoport et al.

[11] Patent Number: 5,841,336

[45] Date of Patent: Nov. 24, 1998

[54] MAGNETIC CORE-COIL ASSEMBLY FOR SPARK IGNITION SYSTEMS

[75] Inventors: William R. Rapoport, Bridgewater, N.J.; Paul A. Papanestor, Milford, Pa.

[73] Assignee: AlliedSignal Inc., Morris Township, N.J.

[21] Appl. No.: 790,339

[22] Filed: Jan. 27, 1997

Related U.S. Application Data

[63] Continuation-in-part of Ser. No. 639,498, Apr. 29, 1996.

[51] Int. Cl.[6] ..... H01F 27/24; H01F 27/28; H01F 38/20

[52] U.S. Cl. ..... 336/212; 336/229; 336/174; 336/178

[58] Field of Search ..... 336/212, 178, 336/229, 171, 174, 175

[56] References Cited

U.S. PATENT DOCUMENTS

| | | | |
|---|---|---|---|
| 4,520,335 | 5/1985 | Rauch et al. | 336/212 |
| 4,529,788 | 7/1985 | Kushnick | 148/403 |
| 4,649,639 | 3/1987 | Mas | 29/605 |
| 4,707,619 | 11/1987 | Chu et al. | 307/106 |
| 4,907,339 | 3/1990 | Alexandrov | 29/605 |
| 5,146,905 | 9/1992 | Davis | 123/599 |
| 5,526,457 | 6/1996 | Noble et al. | 123/425 |

FOREIGN PATENT DOCUMENTS

| | | | |
|---|---|---|---|
| 306117 | 9/1929 | United Kingdom | 336/174 |

*Primary Examiner*—Michael L. Gellner
*Assistant Examiner*—Anh Mai
*Attorney, Agent, or Firm*—John A. Squires; Ernest D. Buff

[57] ABSTRACT

A magnetic core-coil assembly generates an ignition event in a spark ignition internal combustion system having at least one combustion chamber. The assembly comprises a magnetic core of amorphous metal having a primary coil for low voltage excitation and a secondary coil for a high voltage output to be fed to a spark plug. A high voltage is generated in the secondary coil within a short period of time following excitation thereof. The assembly senses spark ignition conditions in the combustion chamber to control the ignition event. The assembly is constructed from sub-assembly parts that can be manufactured with existing machines at reasonable cost.

11 Claims, 4 Drawing Sheets

MAGNETIC CORE-COIL ASSEMBLY FOR SPARK IGNITION SYSTEMS

CROSS REFERENCE TO RELATED APPLICATIONS

This is a continuation-in-part of United States application Ser. No. 08/639,498, filed Apr. 29, 1996.

BACKGROUND OF THE INVENTION

1. Field of the Invention

This invention relates to spark ignition systems for internal combustion engines; and more particularly to a spark ignition system which improves performance of the engine system and reduces the size of the magnetic components in the spark ignition transformer in a commercially producible manner.

2. Description of the Prior Art

In a spark-ignition internal combustion engine, a flyback transformer is commonly used to generate the high voltage needed to create an arc across the gap of the spark plug igniting the fuel and air mixture. The timing of this ignition spark event is critical for best fuel economy and low exhaust emission of environmentally hazardous gases. A spark event which is too late leads to loss of engine power and loss of efficiency. A spark event which is too early leads to detonation, often called "ping" or "knock", which can, in turn, lead to detrimental pre-ignition and subsequent engine damage. Correct spark timing is dependent on engine speed and load. Each cylinder of an engine often requires different timing for optimum performance. Different spark timing for each cylinder can be obtained by providing a spark ignition transformer for each spark plug.

To improve engine efficiency and alleviate some of the problems associated with inappropriate ignition spark timing, some engines have been equipped with microprocessor-controlled systems which include sensors for engine speed, intake air temperature and pressure, engine temperature, exhaust gas oxygen content, and sensors to detect "ping" or "knock". A knock sensor is essentially an electro-mechanical transducer whose sensitivity is not sufficient to detect knock over the whole range of engine speed and load. The microprocessor's determination of proper ignition spark timing does not always provide optimum engine performance. A better sensing of "knock" is needed.

A disproportionately greater amount of exhaust emission of hazardous gases is created during the initial operation of a cold engine and during idle and off-idle operation. Studies have shown that rapid multi-sparking of the spark plug for each ignition event during these two regimes of engine operation reduces hazardous exhaust emissions. Accordingly, it is desirable to have a spark ignition transformer which can be charged and discharged very rapidly.

A coil-per-spark plug (CPP) ignition arrangement in which the spark ignition transformer is mounted directly to the spark plug terminal, eliminating a high voltage wire, is gaining acceptance as a method for improving the spark ignition timing of internal combustion engines. One example of a CPP ignition arrangement is that disclosed by U.S. Pat. No. 4,846,129 (hereinafter "the Noble patent"). The physical diameter of the spark ignition transformer must fit into the same engine tube in which the spark plug is mounted. To achieve the engine diagnostic goals envisioned in the Noble patent, the patentee discloses an indirect method utilizing a ferrite core. Ideally the magnetic performance of the spark ignition transformer is sufficient throughout the engine operation to sense the sparking condition in the combustion chamber. Clearly, a new type of ignition transformer is needed for accurate engine diagnosis.

Engine misfiring increases hazardous exhaust emissions. Numerous cold starts without adequate heat in the spark plug insulator in the combustion chamber can lead to misfires, due to deposition of soot on the insulator. The electrically conductive soot reduces the voltage increase available for a spark event. A spark ignition transformer which provides an extremely rapid rise in voltage can minimize the misfires due to soot fouling.

To achieve the spark ignition performance needed for successful operation of the ignition and engine diagnostic system disclosed by Noble and, at the same time, reduce the incidence of engine misfire due to spark plug soot fouling, the spark ignition transformer's core material must have certain magnetic permeability, must not magnetically saturate during operation, and must have low magnetic losses. The combination of these required properties narrows the availability of suitable core materials. Considering the target cost of an automotive spark ignition system, possible candidates for the core material include silicon steel, ferrite, and iron-based amorphous metal. Conventional silicon steel routinely used in utility transformer cores is inexpensive, but its magnetic losses are too high. Thinner gauge silicon steel with lower magnetic losses is too costly. Ferrites are inexpensive, but their saturation inductions are normally less than 0.5 T and Curie temperatures at which the core's magnetic induction becomes close to zero are near 200° C. This temperature is too low considering that the spark ignition transformer's upper operating temperature is assumed to be about 180° C. Iron-based amorphous metal has low magnetic loss and high saturation induction exceeding 1.5 T, however it shows relatively high permeability. An iron-based amorphous metal capable of achieving a level of magnetic permeability suitable for a spark ignition transformer is needed. Using this material, it is possible to construct a toroid design coil which meets required output specifications and physical dimension criteria. The dimensional requirements of the spark plug well limit the type of configurations that can be used. Typical dimensional requirements for insulated coil assemblies are <25 mm diameter and are less than 150 mm in length. These coil assemblies must also attach to the spark plug on both the high voltage terminal and outer ground connection and provide sufficient insulation to prevent arc over. There must also be the ability to make high current connections to the primaries typically located on top of the coil.

SUMMARY OF THE INVENTION

The present invention provides a magnetic core-coil assembly for a coil-per-plug (CPP) spark ignition transformer which generates a rapid voltage rise and a signal that accurately portrays the voltage profile of the ignition event. Generally, stated, the magnetic core-coil comprises a magnetic core composed of a ferromagnetic amorphous metal alloy. The core-coil assembly has a single primary coil for low voltage excitation and a secondary coil for a high voltage output. The assembly also has a secondary coil comprising a plurality of core sub-assemblies that are simultaneously energized via the common primary coil. The coil sub-assemblies are adapted, when energized, to produce secondary voltages that are additive, and are fed to a spark plug. As thus constructed, the core-coil assembly has the capability of (i) generating a high voltage in the secondary coil within a short period of time following excitation thereof, and (ii) sensing spark ignition conditions in the combustion chamber to control the ignition event.

More specifically, the core is composed of an amorphous ferromagnetic material which exhibits low core loss and a permeability (ranging from about 100 to 500). Such magnetic properties are especially suited for rapid firing of the plug during a combustion cycle. Misfires of the engine due to soot fouling are minimized. Moreover, energy transfer from coil to plug is carried out in a highly efficient manner, with the result that very little energy remains within the core after discharge. The low secondary resistance of the toroidal design (<100 ohms) allows the bulk of the energy to be dissipated in the spark and not in the secondary wire. This high efficiency energy transfer enables the core to monitor the voltage profile of the ignition event in an accurate manner. When the magnetic core material is wound into a cylinder upon which the primary and secondary wire windings are laid to form a toroidal transformer, the signal generated provides a much more accurate picture of the ignition voltage profile than that produced by cores exhibiting higher magnetic losses. A multiple toroid assembly is created that allows energy storage in the sub-assemblies via a common primary governed by the inductance of the sub-assembly and its magnetic properties. A rapidly rising secondary voltage is induced when the primary current is rapidly decreased. The individual secondary voltages across the sub-assembly toroids rapidly increases and adds sub-assembly to sub-assembly based on the total magnetic flux change of the system. This allows the versatility to combine several sub-assembly units wound via existing toroidal coil winding techniques to produce a single assembly with superior performance. The single assembly that consisted of a single longer toroid could not be easily and economically manufactured via common toroidal winding machines.

The magnetic core-coil assembly of this invention is compatible with capacitive discharge coils. In one embodiment, a capacitor is charged to a voltage (Typically 300–600 volts) and then discharged through the primary of the coil. The coil acts as a pulse transformer so that the voltage that appears across the secondary is related to the turns ratio of secondary to primary. For this type of application the optimal turns ratio is different than the inductive coil optimum. Typically there would be 2–4 primary turns and 150–250 secondary turns. The output pulse would be very short due to core saturation. Efficient toroidal design and the high frequency characteristics of the amorphous metal cores, efficiently transfers energy to the secondary. Typical peak currents are in the several ampere regime and the discharge times are under 60 microseconds.

BRIEF DESCRIPTION OF THE DRAWINGS

The invention will be more fully understood and further advantages will become apparent when reference is made to the following detailed description of the preferred embodiments of the invention and the accompanying drawings, in which.

DESCRIPTION OF THE PREFERRED EMBODIMENTS

Figure 1:
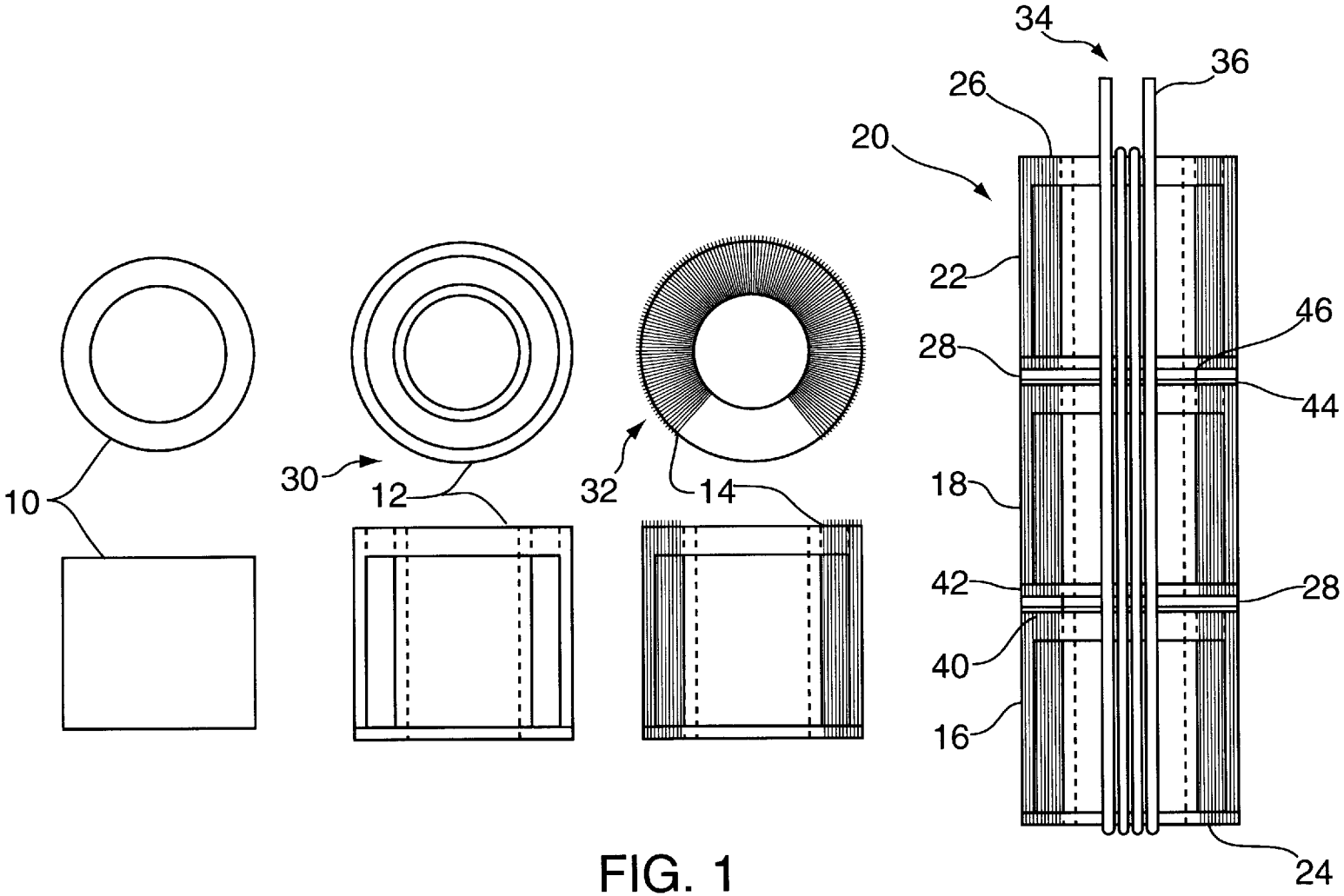
FIG. 1 is an assembly procedure guideline drawing showing the assembly method and connections used to produce the stack arrangement, coil assembly of the present invention.
Figure 4:
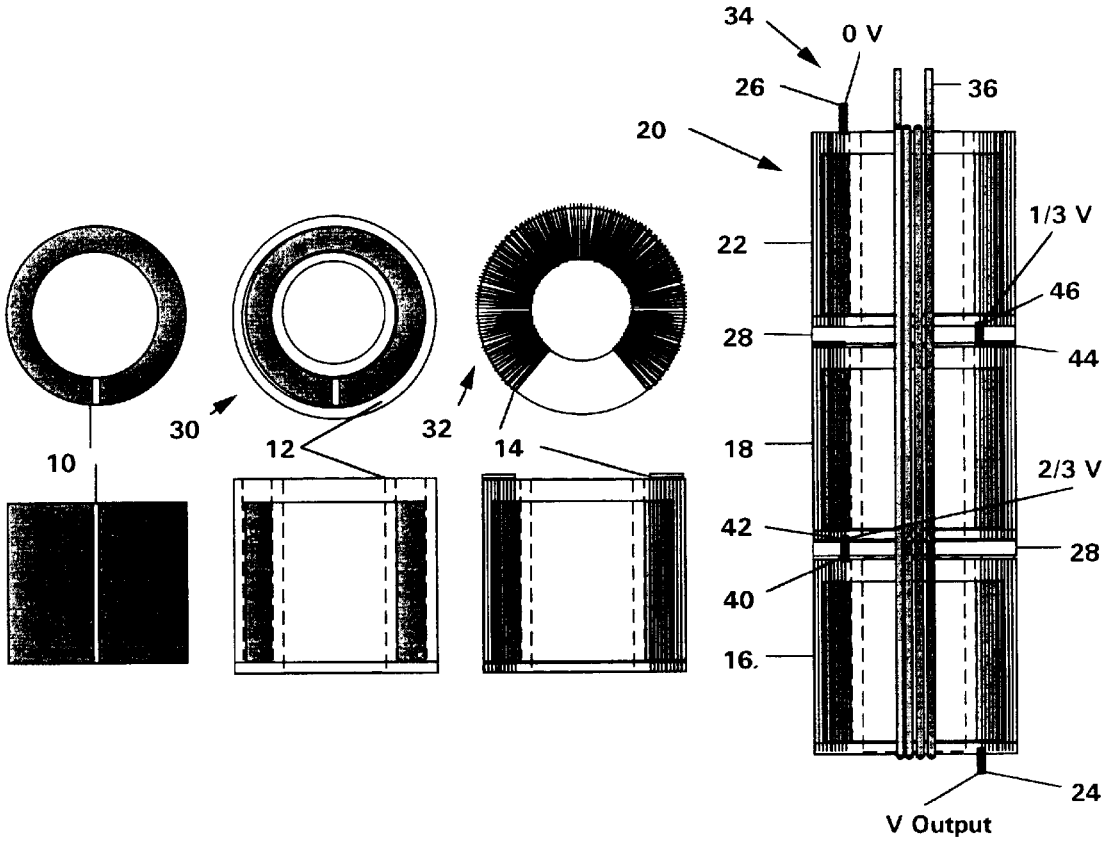
FIG. 4 is the assembly of FIG. 1 having a gapped core.
Figure 5:
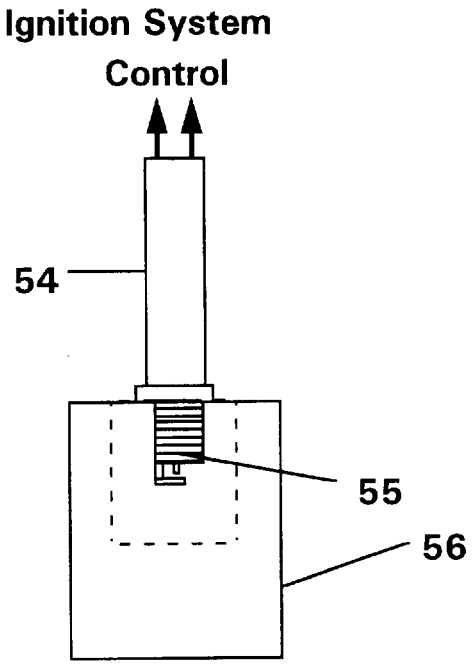
FIG. 5 is a drawing of an engine cylinder top depicting the coil assembly located on top of the spark plug.

Referring to FIG. 1 of the drawings, the magnetic core-coil assembly 34 comprises a magnetic core 10 composed of a ferromagnetic amorphous metal alloy. The core-coil assembly 34 has a single primary coil 36 for low voltage excitation and a secondary coil 20 for a high voltage output. The core-coil assembly 34 also has a secondary coil 20 comprising a plurality of core sub-assemblies (toroidal units) 32 that are simultaneously energized via the common primary coil 36. The core-coil sub-assemblies 32 are adapted, when energized, to produce secondary voltages that are additive, and are fed to a spark plug. As thus constructed, the core-coil assembly 34 has the capability of (i) generating a high voltage in the secondary coil 20 within a short period of time following excitation thereof, and (ii) sensing spark ignition conditions in the combustion chamber to control the ignition event. The magnetic core 10 is based on an amorphous metal with a high magnetic induction, which includes iron-base alloys. Two basic forms of a core 10 are noted. They are gapped and non-gapped and are both refereed to as core 10. The gapped core (shown in FIG. 4) has a discontinuous magnetic section in a magnetically continuous path. An example of such a core 10 is a toroidal-shaped magnetic core having a small slit commonly known as an air-gap. The gapped configuration is adopted when the needed permeability is considerably lower than the core's own permeability as wound. The air-gap portion of the magnetic path reduces the overall permeability. The non-gapped core (shown in FIG. 1) has a magnetic permeability similar to that of an air-gapped core, but is physically continuous, having a structure similar to that typically found in a toroidal magnetic core. The apparent presence of an air-gap uniformly distributed within the non-gapped core 10 gives rise to the term "distributed-gap-core". Both gapped and non-gapped designs function in this core-coil assembly 34 design and are interchangeable as long as the effective permeability is within the required range. Non-gapped cores 10 were chosen for the proof of principle of this modular design, however the design is not limited to the use of non-gapped core material.

The non-gapped core 10 is made of an amorphous metal based on iron alloys and processed so that the core's magnetic permeability is between 100 and 500 as measured at a frequency of approximately 1 kHz. Leakage flux from a distributed-gap-core is much less than that from a gapped-core, emanating less undesirable radio frequency interference into the surroundings. Furthermore, because of the closed magnetic path associated with a non-gapped core, signal-to-noise ratio is larger than that of a gapped-core, making the non-gapped core especially well suited for use as a signal transformer to diagnose engine combustion processes. An output voltage at the secondary core 20 greater than 10 kV for spark ignition is achieved by a non-gapped core 10 with less than 60 Ampere-turns of common primary core 36 and about 110 to 160 turns of secondary coil winding 20. The high voltage output of the secondary coil 20 can exceed 20 kV with a current in the common primary coil 36 of between 75 and 200 Ampere-turns. The high voltage output (both the 10 kV and 20 kV amplitudes) of the secondary coil 20 can be achieved within 25 to 150 $\mu$sec, i.e. the high voltage output of the secondary coil 20 can be repeatedly generated at time intervals of between 25 and 150 $\mu$sec. A capacitive discharge design would have, but not be limited to, a 150–250 turn secondary. Typical secondary to primary turns ratios are in the 50–100 range. Open circuit outputs in excess of 25 kV can be obtained with <180 Ampere-turns. Previously demonstrated coils were comprised of ribbon amorphous metal material that was wound into right angle cylinders with an ID of 12 mm and an OD of 17 mm and a height of 15.6 mm stacked to form an effective cylinder height of nearly 80 mm. Individual cylinder heights could be varied from a single height of near 80 mm to 10 mm as long as the total length met the system requirements. It is not a requirement to directly adhere to the dimensions used in this example. Large variations of design space exist according to the input and output requirements. The final constructed right angle cylinder formed the core of an elongated toroid. Insulation between the core and wire was achieved through the use of high temperature resistant moldable plastic which also doubled as a winding form facilitating the winding of the toroid. Fine gauge wire was used to wind the required 110–160 secondary turns. Since the output voltage of the coil could exceed 25 kV which represents a winding to winding voltage in the 200 volt range, the wires could not be significantly overlapped. The best performing coils had the wires evenly spaced over approximately 180–300 degrees of the toroid. The remaining 60–180 degrees was used for the primary windings. One of the drawbacks to this type of design was the aspect ratio of the toroid and the number of secondary turns required for general operation. A jig to wind these coils was required to handle very fine wire (typically 39 gauge or higher), not significantly overlap these wires and not break the wire during the winding operation. Typical toroid winding machines (Universal) are not capable of winding coils near this aspect ratio due to their inherent design. Alternative designs based on shuttles that are pushed through the core and then brought around the outer perimeter were required and had to be custom produced. Typically the time to wind these coils was very long. The elongated toroid design, though functional would be difficult to mass produce at a sufficiently low cost to be commercially attractive.

An alternative design breaks the original design down into a smaller component level structure in which the components can be routinely wound using existing coil winding machines. The concept is to take core sections of the same base amorphous metal core material of manageable size and unitize it. This is accomplished by forming an insulator cup 12 that allows the core 10 to be inserted into it and treating that sub-assembly 30 as a core to be wound as a toroid 32. The same number of secondary turns 14 are required as the original design. The final assembly 34 can consist of a stack of a sufficient number (1 or greater) of these segmented core structures 32 to achieve the desired output characteristics with one significant change. Every other toroid unit 32 must be wound oppositely. This allows the output voltages to add. A typical structure 34 would consist of the first toroidal unit 16 being wound counterclockwise (ccw) with one output wire 24 acting as the final coil assembly 34 output. The second toroidal unit 18 would be wound clockwise (cw) and stacked on top of the first toroidal unit 16 with a spacer 28 to provide adequate insulation. It is possible to replace the spacer 28 with a series of vertical rods that extend up from the top of the insulator cup 12. Those rods would fit into sockets that were in the corresponding sections in the bottom of each insulator cup 12. This would create the same spacing that spacer 28 did. The bottom lead 42 of the second toroidal unit 18 would attach to the upper lead 40 (remaining lead) of the first toroidal unit 16. The next toroidal unit 22 would be wound ccw and stacked on top of the previous two toroidal units 16,18 with a spacer 28 for insulation purposes. The lower lead 46 of the third toroidal unit 22 would connect to the upper lead 44 of the second toroidal unit. The total number of toroidal units 32 is set by design criteria and physical size requirements. The final upper lead 26 acts as the ground lead of the core-coil assembly 34. These secondary windings 14 of these toroidal units 32 are individually wound so that approximately 180–300 of the 360 degrees of the toroid is covered. The toroidal units 32 are stacked so that the open 60–180 degrees of each toroid unit 32 are vertically aligned. A common primary coil 36 is wound through this core-coil assembly 34. This will be referred to as the stacker concept.

The voltage distribution around the original coil design resembles a variac with the first turn being at zero volts and the last turn is at full voltage. This is in effect over the entire height of the coil structure. The primary winding kept isolated from the secondary windings and is located in the center of the 60–180 degree free area of the wound toroid. These lines are essentially at low potential due to the low voltage drive conditions used on the primary. The highest voltage stresses occur at the closest points of the high voltage output and the primary, the secondary to secondary windings and the secondary to core. The highest electric field stress point exists down the length of the inside of the toroid and is field enhanced at the inner top and bottom of the coil. The stacker concept voltage distribution is slightly different. Each individual core-coil toroidal unit 32 has the same variac type of distribution, but the stacked distribution of the core-coil assembly 34 is divided by the number of individual toroidal units 32. If there are three toroidal units 32 in the core-coil assembly 34 stack, then the voltage produced by the bottom toroidal unit 16 will range from V to ⅔ V, the second toroidal unit 18 will range from ⅔ V to ⅓ V and the top toroidal unit 22 will range from ⅓ V to 0 V. This configuration lessens the area of high voltage stress. Another issue with the original coil design is capacitive coupling of the output though the insulator case to the outside world. The output voltage waveform has a short pulse component (typically 1–3 microseconds in duration with a 500 ns rise time) and a much longer low level output component (typically 100–150 microseconds duration). Some of the fast pulse output component capacitively couples out through the walls of the insulator. The variac effect can noted by observing corona on the outer shell. The capacitive coupling can rob the output to the spark plug by partially shunting it through the case to ground. This effect is only a problem at the very high voltage ranges where it can reduce the open circuit voltage of the device by corona discharge. The stacker arrangement voltage distribution is different and allows the highest voltage section to be located on the top or bottom of the core-coil assembly 34 depending on the grounding configuration. The advantage in this design is that the high voltage section can be placed right at the spark plug deep in the spark plug well. The voltage at the top of the core-coil assembly 34 would maximize at only ⅓ V for a 3 stack unit. The same voltage distribution would exist for the capacitive discharge embodiment.

Figure 2:
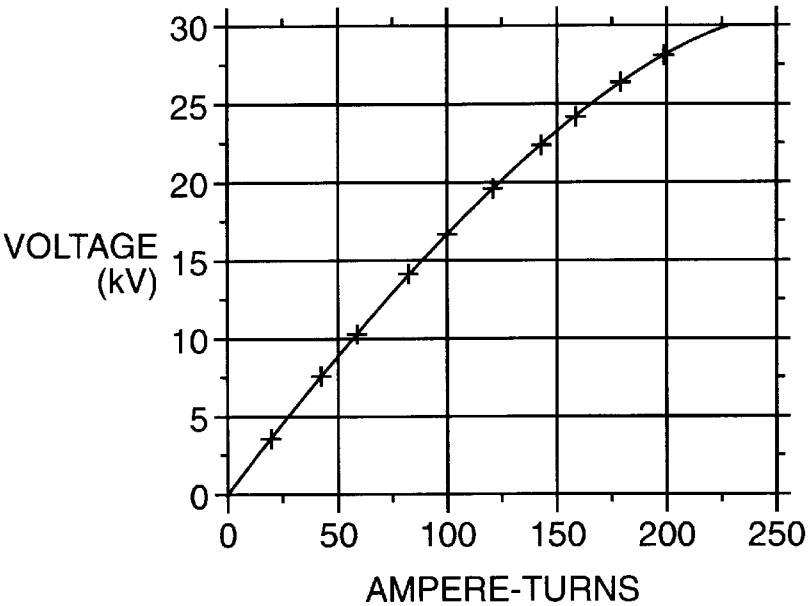
FIG. 2 is a graph showing the output voltage across the secondary for the Ampere-turns on the primary coil of the assembly shown in FIG. 1.

Magnetic cores composed of an iron-based amorphous metal having a saturation induction exceeding 1.5 T in the as-cast state were prepared. The cores had a cylindrical form with a cylinder height of about 15.6 mm and outside and inside diameters of about 17 and 12 mm, respectively. These cores were heat-treated with no external applied fields. FIG. 1 shows a procedure guideline drawing of the construction of a three stack core-coil assembly 34 unit. These cores 10 were inserted into high temperature plastic insulator cups 12. Several of these units 30 were machine wound cw on a toroid winding machine with 110 to 160 turns of copper wire forming a secondary winding 14 and several were wound ccw. The first toroidal unit 16 (bottom) is wound ccw with the lower lead 24 acting as the system output lead. The second toroidal unit 18 is wound cw and its lower lead 42 is connected to the upper lead 40 of the first toroidal unit 16. The third toroidal unit 22 is wound ccw and its lower lead 46 is connected to the upper lead 44 of the second toroidal unit 18. The upper lead 26 of the third toroidal unit 22 acts as the ground lead. Plastic spacers 28 between the toroidal units 16, 18, 22 act as voltage standoffs. The non-wound area of the toroidal units 32 are vertically aligned. A common primary 36 is wound through the core-coil assembly 34 stack in the clear area. This core-coil assembly 34 is encased in a high temperature plastic housing with holes for the leads. This assembly is then vacuum-cast in an acceptable potting compound for high voltage dielectric integrity. There are many alternative types of potting materials. The basic requirements of the potting compound are that it possess sufficient dielectric strength, that it adheres well to all other materials inside the structure, and that it be able to survive the stringent environment requirements of cycling, temperature, shock and vibration. It is also desirable that the potting compound have a low dielectric constant and a low loss tangent. The housing material should be injection moldable, inexpensive, possess a low dielectric constant and loss tangent, and survive the same environmental conditions as the potting compound. A current was supplied in the primary coil 36, building up rapidly within about 25 to 100 $\mu$sec to a level up to but not limited to 60 amps. FIG. 2 shows the output attained when the primary current is rapidly shut off at a given peak Ampere-turn. The charge time was typically <120 microseconds with a voltage of 12 volts on the primary switching system. The output voltage had a typical short output pulse duration of about 1.5 microseconds FWHM and a long low level tail that lasted approximately 100 microseconds. Thus, in the magnetic core-coil assembly 34, a high voltage, exceeding 10 kV, can be repeatedly generated at time intervals of less than 200 $\mu$sec. This feature is required to achieve the rapid multiple sparking action mentioned above. Moreover, the rapid voltage rise produced in the secondary winding reduces engine misfires resulting from soot fouling.

Figure 3:
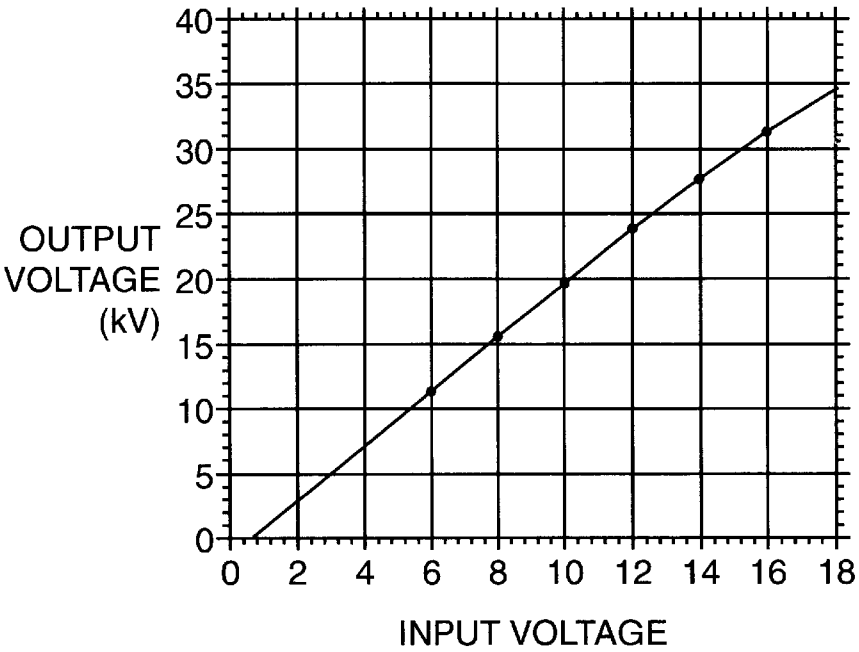
FIG. 3 is a graph showing the output voltage across the secondary for a given input voltage on a capacitive discharge system driver for the coil of the assembly shown in FIG. 1.

This type of advantage is also shared with the capacitive discharge design. The system is faster than the inductive design allowing multiple strike capability every 70 microseconds or so. This type of system is capable of operating with a lower value of shunt resistance than the inductive design. FIG. 3 shows the output voltage result for an adjustable input voltage. In this figure, a dc-dc converter steps the voltage up from that on the x-axis to the several hundred volt range, but that value is linear with the adjustable voltage.

In addition to the advantages relating to spark ignition event described above, the core-coil assembly 34 of the present invention serves as an engine diagnostic device. Because of the low magnetic losses of the magnetic core 10 of the present invention, the primary voltage profile reflects faithfully what is taking place in the cumulative secondary windings. During each rapid flux change inducing high voltages on the secondary, the primary voltage lead is analyzed during the firing duration, for proper ignition characteristics. The resulting data are then fed to the ignition system control. The present core-coil assembly 34 thus eliminates the additional magnetic element required by the system disclosed in the Noble patent, wherein the core is composed of a ferrite material.

The following example is presented to provide a more complete understanding of the invention. The specific techniques conditions, materials, proportions and reported data set forth to illustrate the principles and practice of the invention are exemplary and should not be construed as limiting the scope of the invention.

EXAMPLE

An amorphous iron-based ribbon having a width of about 15.6 mm and a thickness of about 20 $\mu$m was wound on a machined stainless steel mandrel and spot welded on the ID and OD to maintain tolerance. The inside diameter of 12 mm was set by the mandrel and the outside diameter was selected to be 17 mm. The finished cylindrical core weighed about 10 grams. The cores were annealed in a nitrogen atmosphere in the 430° to 450° C. range with soak times from 2 to 16 hours. The annealed cores were placed into insulator cups and wound on a toroid winding machine with 140 turns of thin gauge insulated copper wire as the secondary. Both ccw and cw units were wound. A ccw unit was used as the base and top units while a cw unit was the middle unit. Insulator spacers were added between the units. Four turns of a lower gauge wire, forming the primary, were wound on the toroid sub-assembly in the area where the secondary windings were not present. The middle and lower unit's leads were connected as well as the middle and upper units leads. The assembly was placed in a high temperature plastic housing and was potted. With this configuration, the secondary voltage was measured as a function of the primary current and number of primary turns, and is set forth below in FIG. 2.

Having thus described the invention in rather full detail, it will be understood that such detail need not be strictly adhered to but that further changes and modifications may suggest themselves to one skilled in the art, all falling within the scope of the invention as defined by the subjoined claims.

What is claimed is:

1. A magnetic core-coil assembly for generating an ignition event in a spark ignition internal combustion system having at least one combustion chamber, said assembly comprising:

a magnetic core composed of ferromagnetic amorphous metal alloy, said core having a common primary coil for low voltage excitation and a secondary coil for a high voltage output;

secondary coil comprising a plurality of stacked 360 degree toroidal core-coil sub-assemblies connected in series with each other that are simultaneously energized in response to the low voltage excitation of said common primary coil, each of said core-coil sub-assemblies comprising a toroidally wound section having a secondary winding wound in a predetermined direction that alternates between clockwise and counterclockwise for adjacent core-coil sub-assemblies such that adjacently stacked core-coil sub-assemblies are not wound in the same predetermined direction and said secondary windings cover approximately 180 to 300 degrees of the 360 degrees of each of said core-coil sub-assemblies;

said core-coil sub-assemblies, when simultaneously energized by said common primary coil, producing secondary voltages that are additive, said high voltage output being the sum of said secondary voltages which are collectively fed to a spark plug to generate the ignition event in the internal combustion system; and said magnetic core-coil sub-assembly repeatedly generating said high voltage output in said secondary coil within a predetermined period of time following the low voltage excitation of said common primary coil.

2. A magnetic core-coil assembly as recited in claim 1; wherein said magnetic core is a heat-treated ferromagnetic amorphous metal alloy.

3. A magnetic core-coil assembly as recited in claim 1, wherein said magnetic core comprises a plurality of segmented cores.

4. A magnetic core-coil as recited in claim 2, wherein said ferromagnetic amorphous metal alloy is iron based and further comprises metallic elements including nickel and cobalt, glass forming elements including boron and carbon, and semi-metallic elements including silicon.

5. A magnetic core-coil assembly as recited in claim 4, wherein said magnetic core is a ferromagnetic amorphous alloy heat-treated at a temperature near the alloy's crystallization temperature and partially crystallized.

6. A magnetic core-coil assembly as recited in claim 2, wherein said magnetic core is physically continuous.

7. A magnetic core-coil assembly as recited in claim 6, wherein said magnetic core is a ferromagnetic amorphous alloy heat-treated below the alloy's crystallization temperature and, upon completion of the heat treatment, remains substantially in an amorphous state.

8. A magnetic core-coil assembly as recited in claim 2, wherein said magnetic core is physically discontinuous.

9. A magnetic core-coil assembly as recited in claim 1, said assembly having an internal voltage distribution in said secondary coil that is segmentally stepped, the number of segments being determined by the number of core-coil sub-assemblies comprising said secondary coil.

10. A magnetic core-coil assembly as recited in claim 1, wherein said high voltage output exceeds 10 kV with a primary current in said common primary coil of less than 60 Ampere-turns within a predetermined period of time of between 125 and 200 $\mu$sec.

11. A magnetic core-coil assembly as recited in claim 1, wherein said high voltage output exceeds 20 kV with a primary current in said common primary coil of between 75 and 200 Ampere-turns within a predetermined period of time of between 125 and 200 $\mu$sec.

* * * * *